United States Patent [19]

Ricketts

[11] Patent Number: 4,531,783

[45] Date of Patent: Jul. 30, 1985

[54] STABILITY CONTROL IN UNDERGROUND WORKINGS ADJACENT AN IN SITU OIL SHALE RETORT

[75] Inventor: Thomas E. Ricketts, Grand Junction, Colo.

[73] Assignee: Occidental Oil Shale, Inc., Grand Junction, Colo.

[21] Appl. No.: 615,699

[22] Filed: May 29, 1984

Related U.S. Application Data

[63] Continuation of Ser. No. 314,674, Oct. 26, 1981, abandoned.

[51] Int. Cl.[3] ..... E21C 41/10

[52] U.S. Cl. ..... 299/2; 166/259

[58] Field of Search ..... 299/2, 11, 13, 19; 166/259, 256

[56] References Cited

U.S. PATENT DOCUMENTS

| | | | |
|---|---|---|---|
| 4,133,580 | 9/1979 | French | 299/2 |
| 4,140,343 | 2/1979 | Mills | 299/2 |
| 4,192,553 | 3/1980 | Studebaker et al. | 299/2 |
| 4,272,127 | 6/1981 | Hutchins et al. | 299/2 |

FOREIGN PATENT DOCUMENTS

| | | | |
|---|---|---|---|
| 913644 | 6/1954 | Fed. Rep. of Germany | 299/2 |

*Primary Examiner*—Stephen J. Novosad
*Assistant Examiner*—Thuy M. Bui
*Attorney, Agent, or Firm*—Christie, Parker & Hale

[57] ABSTRACT

In situ oil shale retorts are formed in spaced-apart rows, with adjacent rows of such retorts being separated by load-bearing inter-retort pillars of unfragmented formation sufficiently strong for preventing substantial subsidence. Each retort contains a fragmented permeable mass of formation particles containing oil shale. An air level drift is excavated in formation directly above the inter-retort pillar so that the roof and/or floor of the air level drift is spaced above the upper boundaries of the retorts in such adjacent rows. This causes the roof of the air level drift to be in compression, rather than in tension, which stabilizes the roof and avoids dangerous rock falls. During retorting operations, air is introduced at the upper edge of each retort through lateral air inlet passages sloping downwardly from the air level drift. Off gas and liquid products are withdrawn from each retort through a production level passage at the bottom of each retort at the edge opposite the air inlet. The production level passages connect to a main production level drift extending between adjacent rows of retorts. The roof of the main production level drift is excavated in formation directly below the inter-retort pillar so that the roof of the production level drift is spaced below the lower boundaries of the retorts in adjacent rows. This places the roof of the production level drift in compression, avoiding the likelihood of rock falls.

19 Claims, 3 Drawing Figures

PRIOR ART

STABILITY CONTROL IN UNDERGROUND WORKINGS ADJACENT AN IN SITU OIL SHALE RETORT

This is a continuation of application Ser. No. 314,674 filed Oct. 26, 1981 now abandoned.

BACKGROUND OF THE INVENTION

1 Field of the Invention

This invention relates to in situ recovery of shale oil, and more particularly to techniques for stabilizing the roof of underground workings adjacent an in situ oil shale retort.

2. Description of the Prior Art

The presence of large deposits of oil shale in the semiarid high plateau region of the Western United States has given rise to extensive efforts to develop methods for recovering shale oil from kerogen in the oil shale deposits. It should be noted that the term "oil shale" as used in the industry is in fact a misnomer; it is neither shale, nor does it contain oil. It is a sedimentary formation comprising marlstone deposit with layers containing an organic polymer called "kerogen", which upon heating decomposes to produce liquid and gaseous products. It is the formation containing kerogen that is called "oil shale" herein, and the liquid hydrocarbon product is called "shale oil".

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits have been described in several patents, such as U.S. Pat. Nos. 3,661,423; 4,043,595; 4,043,596; 4,043,597; 4,043,598; and 4,192,554, which are incorporated herein by this reference. These patents describe in situ recovery of liquid and gaseous hydrocarbon materials from a subterranean formation containing oil shale, wherein such formation is explosively expanded for forming a stationary fragmented permeable mass of formation particles containing oil shale within the formation, referred to herein as an situ oil shale retort. Retorting gases are passed through the fragmented mass to convert kerogen contained in the oil shale to liquid and gaseous products, thereby producing retorted oil shale. One method of supplying hot retorting gases used for converting kerogen contained in the oil shale, as described in U.S. Pat. No. 3,661,423, includes establishing a combustion zone in the fragmented mass and introducing an oxygen-supplying retort inlet mixture into the retort to advance the combustion zone through the fragmented mass. In the combustion zone, oxygen from the retort inlet mixture is depleted by reaction with hot carbonaceous material to produce heat, combustion gas, and combusted oil shale. By continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products, and a residual solid carbonaceous material.

The liquid products and the gaseous products are cooled by the cooler oil shale fragments in the retort on the advancing side of the retorting zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition, and any gaseous retort inlet mixture that does not take part in the combustion process. The products of retorting are referred to herein as liquid and gaseous products.

In developing a mining system for a tract of in situ oil shale retorts, a number of factors must be considered. These include maximizing the amount of resource recovery, avoiding substantial subsidence of overburden, stabilizing drift systems to avoid safety hazards to workers present in the drift systems, and reducing mining and construction costs to a reasonable level.

In developing a mining system, there is a trade-off between retorting as much oil shale as possible to maximize resource recovery, and leaving sufficient unrecovered oil shale in the supporting pillars of unfragmented formation for supporting the weight of the overburden to avoid substantial subsidence. Subsidence can result in fracturing of overburden with consequent leakage of water from overlying aquifers into retort or mining areas, leakage of gas from completed retorts, and leakage of air into retorts during retorting operations. Such subsidence can occur when the extraction ratio in the tract is large and the remaining unfragmented formation is not sufficient for supporting the weight of the overburden.

A mining system also should provide stability in underground workings, such as drifts, where operating personnel are present, so that safety hazards, such as dangerous rock falls, can be avoided.

In some mining systems, moderate subsidence of overburden is tolerated. For example, U.S. Pat. No. 4,176,882 to Studebaker et al discloses a "controlled subsidence" technique for forming a tract of in situ retorts, in which moderate, but controlled, subsidence of overburden is permitted. In this system, partitions of unfragmented formation between adjacent retorts do not support overburden loads, resulting in a controlled amount of subsidence of overburden. In this technique, the partitions that separate adjacent retorts are about 30 feet thick. Rather than being load-bearing, such partitions yield under the load of the overburden; that is, the partitions support substantially the same proportionate amount of load of the overburden as the adjacent fragmented masses. In such a controlled subsidence technique, resource recovery is high because the retorts are closely spaced, separated only by the thin, non-load-bearing partitions. By allowing moderate subsidence to occur, the intent is to prevent abrupt fracture or shearing of overburden. U.S. Pat. No. 4,140,343 to Mills shows a similar controlled subsidence arrangement for a tract of in situ retorts, in which non-load-bearing pillars about 50 feet thick separate adjacent groups of retorts, while thinner partitions about 25 feet thick separate retorts within each group from one another.

As an alternative to a controlled subsidence technique, "non-subsiding" mining systems also have been proposed for developing a tract of in situ oil shale retorts. In a non-subsiding technique, relatively thick load-bearing barrier pillars of unfragmented formation are left between adjacent groups of in situ retorts. Following formation of fragmented masses within such a group of in situ retorts, the load normally supported by unfragmented formation within the retort sites is transferred to the load-bearing barrier pillars adjacent the groups of retorts. The pillars support the overburden loads sufficiently to minimize subsidence of overburden. This system can have high resource recovery because the barrier pillars can later be retorted in a second pass of a "two-pass" retorting operation. Such a two-pass system is described in U.S. Pat. No. 4,219,237 to Sisemore.

A mining system for developing a tract of in situ oil shale retorts also must be economically feasible. For example, the mining and construction costs involved in preparing a system of in situ retorts can be reduced tremendously by eliminating excavation of drift systems at one or more levels within the retort system. For instance, some retort mining systems have a separate air level drift system excavated at an elevation above each row of retorts for supplying air to the retorts during subsequent retorting operations. It is common to also provide one or more drift systems at a production level at an elevation near the bottom of the retorts in each row for withdrawing liquid and gaseous products of retorting.

The present invention provides a "non-subsiding" system of in situ oil shale retorts. This system is economical in that a single air inlet drift system supplies air to a pair of adjacent rows of retorts during retorting operations, rather than providing a separate air inlet drift for supplying air to the retorts in each row during retorting operations. A single production level drift system also can be provided for later collecting products of retorting from retorts in a pair of adjacent rows of retorts during retorting operations. The air inlet drifts and production level drifts are offset laterally from the side boundaries of the retorts rather than being directly above or below the retorts. In such an arrangement, it has been discovered that the roof of the air inlet drifts and especially the production level drifts can be subject to instability problems. The present mining system employs techniques for stabilizing the drifts communicating with the retorts to assure that hazardous conditions, such as dangerous rock falls or cracking into the retorts, are not likely.

SUMMARY OF THE INVENTION

Briefly, one embodiment of the invention provides techniques for stabilizing a roof of unfragmented formation above an air level drift formed in the vicinity of a load-bearing inter-retort pillar of unfragmented formation between adjacent rows of in situ oil shale retorts. Such load-bearing inter-retort pillars are sufficiently strong for preventing substantial subsidence of overburden. The air left drift is excavated so that the roof of the air level drift is spaced above the upper boundaries of the adjacent retorts, i.e., above the inter-retort pillar that separates the adjacent rows of retorts. Calculations have shown that formation adjacent the roof of such an air level drift is in compression, which helps assure that dangerous rock falls are not likely. On the other hand, similar calculations have shown that tension exists in the formation adjacent the roof of an air level drift having its roof at about the same elevation as the top boundaries of such adjacent retorts. Tension in the formation raises a series possibility of dangerous rock falls, since strength of rock in tension is negligible. This condition also could lead to cracking into retorts.

In another embodiment, similar techniques are provided for stabilizing unfragmented formation adjacent a roof of a production level drift formed at the horizontal location of a load-bearing inter-retort pillar of unfragmented formation between adjacent rows of in situ oil shale retorts. The production level drift is excavated so that the roof of the production level drift is spaced sufficiently far below the lower boundaries of the adjacent retorts to place formation adjacent the roof of the production level drift in compression, which assures that dangerous rock falls or cracking also are not likely in the production level drift. In one embodiment, the drift further down than the air drift is located above the retorts, since there is more tension on the floor or roof closest to the region between the retorts where the lateral stresses are absent.

DRAWINGS

These and other aspects of the invention will be more fully understood by referring to the following detailed description and the accompanying drawings, in which.

DESCRIPTION OF A RETORT SYSTEM

Figure 1:
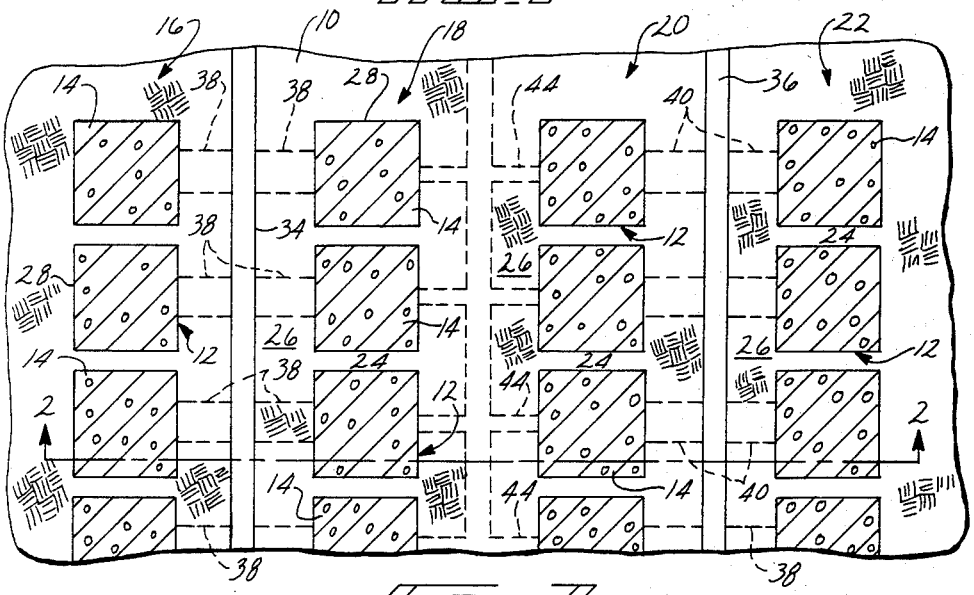
FIG. 1 is a fragmentary, semi-schematic, cross sectional plan view, taken on line 1—1 of FIG. 2, illustrating an array of in situ oil shale retorts in which an air level drift system and a production level drift system are formed according to principles of this invention.

FIG. 1 is a plan view in horizontal cross section semi-schematically illustrating a portion of an in situ oil shale retort system formed in a subterranean formation 10 containing oil shale. The illustrated embodiment is a small area of an oil shale tract, indicating locations of several rows of in situ oil shale retorts 12 formed in the subterranean formation.

The individual in situ oil shale retorts, when completed by explosive expansion techniques, comprise a fragmented permeable mass 14 of formation particles containing oil shale. In preparing each retort for explosive expansion, formation from within the boundaries of each retort site is excavated to form at least one void, leaving a remaining portion of unfragmented formation within the boundaries of the retort site. The remaining portion of unfragmented formation is explosively expanded toward such a void or voids to form the fragmented mass within the retort boundaries.

The in situ retorts 12 are arranged in an array which includes parallel rows 16, 18, 20, 22, of retorts, also referred to herein as first, second, third and fourth rows of retorts. The rows of retorts 12 are horizontally spaced apart substantially equidistantly from one another. The retorts within each row also are horizontally spaced apart substantially equidistantly from one another along the length of the row, leaving vertically extending partitions or gas barriers 24 of unfragmented formation between the side boundaries of adjacent fragmented masses in each row.

Load-bearing inter-retort pillars 26 of unfragmented formation are left between adjacent rows of retorts in the oil shale tract. The inter-retort pillars are sufficiently wide to provide support for overburden above the upper boundaries of the retorts 12. Barrier pillars (not shown) are on the ends of the rows of retorts. The barrier pillars separate panels of retorts from one another. The barrier pillars can have two parallel mining drifts within them. The barrier pillars are load-supporting. The retort system is an essentially "non-subsiding" arrangement in which subsidence of overburden is minimized by the load-supporting inter-retort pillars and barrier pillars. The pillars are designed sufficiently strong for preventing substantial subsidence. The required width of the inter-retort pillars is dependent on depth below the ground surface, properties of the unfragmented formation, temperature effects, and the like, and can be estimated by known techniques. These load-bearing pillars also act as gas barriers to isolate retorting operations in the fragmented masses within each row from retorting operations in adjacent rows. The narrow partitions or gas barriers of unfragmented formation 24 which separate the fragmented masses within each row also act as a gas seal for isolating retorting operations in the fragmented masses within each row from one another. These semi-permeable partitions are non-load-bearing, i.e., they can be sufficiently thin that they do not provide significantly more support for overburden than the adjacent fragmented masses.

The retorts are preferably rectangular or square in horizontal cross section. In the illustrated embodiment, which is but one example of possible arrangements of the in situ retort system, the retorts are square in horizontal cross section, with each retort being about 160 feet wide on each side. The retorts can be a few hundred feet in height. The main inter-retort pillars 26 of unfragmented formation which separate adjacent rows of retorts are about 160 feet thick. In this arrangement, where the thickness of the inter-retort pillar is about the same order of thickness as the adjacent fragmented masses, the pillar has sufficient load-bearing capability to support overburden loads without substantial subsidence of overburden. The semi-permeable partitions or gas barriers 24 between adjacent retorts in each row can be about 50 feet thick, which provides adequate gas seals between retorts for isolating retorting operations. A partition of this thickness is not considered to be load-bearing. The partitions 24 between retorts within a row may actually bear some overburden load, but they can be considered non-load-bearing, since the pillars 26 between rows are sufficient for bearing the overburden loads without substantial subsidence throughout the useful life of the region being developed. The dimensions in this embodiment are exemplary only and are set forth for the purpose of indicating principles of this invention.

Figure 2:
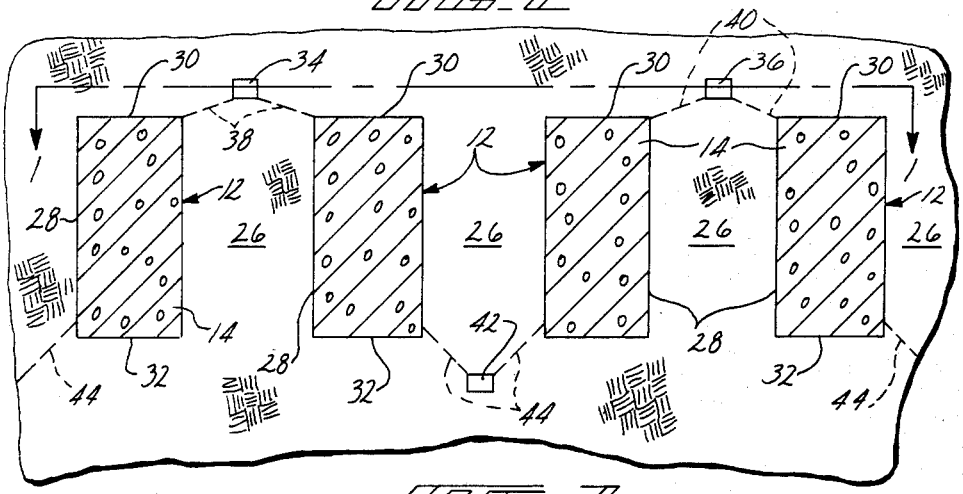
FIG. 2 is a fragmentary, semi-schematic vertical cross section taken on line 2—2 of FIG. 1.

FIG. 2 is a vertical cross section of the retorts along line 2—2 in FIG. 1, with the cross section being taken through one retort in each row. The fragmented masses 14 are formed within vertical side boundaries 28 of each retort site. Each retort has a generally horizontal upper boundary 30 and a generally horizontal lower boundary 32. The upper and lower boundaries of retorts in adjacent rows generally lie within common upper and lower planes. In an alternative configuration, retorts in adjacent rows can have sloping lower boundaries with the lower boundaries of retorts in one row sloping downwardly toward retorts in an adjacent row. If the deposit dips, the retorts can follow the dip angle, and be located between parallel planes which will be slanted from horizontal.

A first main air level drift 34 is excavated on an upper working level spaced above the inter-retort pillar of unfragmented formation between the first and second rows 16, 18 of retorts. Similarly, a second main air level drift 36 is excavated on an upper working level spaced above the inter-retort pillar of unfragmented formation between the third and fourth rows 20, 22 of the retorts. The main air level drifts extend parallel to one another between the adjacent rows of retorts; and each main air level drift is excavated approximately equidistantly from retorts in the adjacent rows of retorts.

The roof of each air level drift 34, 36 is spaced above the top boundaries 30 of the retorts in the adjacent rows of retorts. Although the elevation of the floor of each air level drift can differ, preferably the floor of each air level drift is at or above the top boundaries of the retorts in adjacent rows. Opposite ends of each air level drift are ramped down to the closest drift in the barrier pillar at the end of each row of retorts.

Lateral air inlet passages such as air winzes or bore holes (shown schematically at 38) slant downwardly in opposite directions from the first main air level drift 34 to the nearest upper edge of each of the retorts in the first and second rows 16, 18 on opposite sides of the first air level drift. Similar lateral air inlet passages (shown schematically at 40) slant downwardly in opposite directions from the second main air level drift 36 to the upper edge of each of the retorts in the third and fourth rows 20, 22. Although FIG. 1 shows a pair of such lateral air inlet passages extending from the main air level drift to each retort, the number of such passages leading into each retort from the air level drift can vary. There can be six to eight bore holes or winzes to each retort, for example. The lateral air inlet passages provide fluid communication between each main air level drift and the upper edges of the retorts in adjacent rows for supplying air to the fragmented masses during subsequent retorting operations.

A main production level drift 42 is excavated at a production level between adjacent rows of retorts. The main production level drift is excavated along a side of each row of retorts that is opposite the side from which the same row of retorts receives air from the air level drift system. In the illustrated embodiment, a main production level drift 42 is excavated between the second and third rows 18, 20 of retorts. The main production level drift is excavated generally equidistantly from the second and third rows of retorts. The roof of the production level drift is preferably spaced below the bottom boundaries of the retorts in the adjacent rows.

Off gas and liquid products are withdrawn from each retort by separate production level withdrawal passages 44 at the lower edge of each retort opposite from the upper edge at which air is received from the air level drift system. The production level withdrawal passages slant downwardly away from the retorts and connect to the main production level drift 42 which extends between adjacent rows or retorts. Although one production level passage is shown for each retort, more than one passage per retort can be used. Preferably, additional drifts (not shown) through each row of retorts at the elevation of the lower boundaries of the retorts are used as a means of access to lower retort levels for mining out void spaces within the retorts. Such a technique for providing access along a row of retorts for excavating void spaces is shown in U.S. Pat. No. 4,192,553. This is preferred over using the main production level drifts for excavation, since the grade on lateral access drifts could be too steep for wheeled vehicles.

During retorting operations, formation particles at the top of each fragmented mass are ignited to establish a combustion zone at the top of the fragmented mass. Air or other oxygen-supplying gas is introduced into one upper edge of each fragmented mass from the air inlet passages. The air or other retort inlet mixture sustains the combustion zone and causes it to advance through the fragmented mass. Combustion gas produced in the combustion zone passes through the fragmented mass to establish a retorting zone on the advancing side of the combustion zone where kerogen in the fragmented mass is converted to liquid and gaseous products of retorting. Liquid products, namely, shale oil and water, and off gas produced during operation of each retort are withdrawn from the fragmented mass through the production level drift on the lower, opposite edges of the fragmented mass. The gas flow through the fragmented mass is generally diagonally from the upper edge of the side boundary adjacent the air level drift toward a lower outlet at the lower edge of the opposite side boundary adjacent the production level drift. The shale oil, water, and off gas can be withdrawn separately from the production level drift and passed to above ground.

EXPLANATION OF THE RETORT SYSTEM

As described above, the retort system of this invention is developed according to a non-subsiding technique in which the main inter-retort pillars between rows of retorts are sufficiently thick to support overburden loads without substantial subsidence of overburden. It has been proposed that the main air level drifts be excavated within the wide load-bearing main inter-retort pillars between rows of retorts. Excavation of such air level drifts in the wide inter-retort pillars does not adversely affect subsidence of overburden. In contrast, the thin non-load-bearing partitions of unfragmented formation between rows of retorts in the controlled subsidence systems in U.S. Pat. Nos. 4,140,343 and 4,176,882 described above are not sufficiently wide and, therefore, do not have sufficient structural integrity, to allow for excavation of a similar air level drift system in the partitions.

Figure 3:
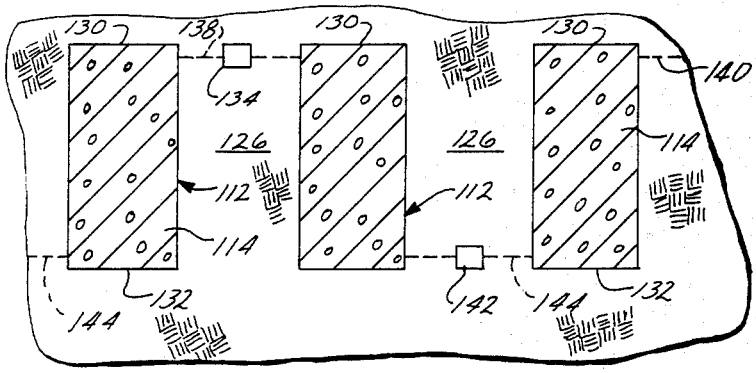
FIG. 3 is a fragmentary, semi-schematic vertical cross section similar to FIG. 2, but illustrating an air level drift and a production level drift of a prior art mining system.

The embodiment of FIG. 3 is an example of a proposed retort system in which the main air level drifts are excavated within the inter-retort pillars of unfragmented formation between the rows of retorts in a non-subsiding in situ retort system. In this embodiment, reference numerals for features similar to the embodiment of FIGS. 1 and 2 are increased by 100. FIG. 3 shows a main air level drift 134 excavated in an inter-retort pillar 126 of unfragmented formation between two adjacent rows of in situ retorts 112. The roof of the air level drift is at about the same elevation as the top boundaries 130 of the retorts in adjacent rows. During retorting operations, air is introduced into the upper edge of each fragmented mass from the main air level drift through generally horizontally extending air inlet passages 138. Off gas and liquid products are withdrawn from the fragmented masses by production level cross-drifts 144 at the bottom of each retort at the edge opposite from the air level drift. The production level cross-drifts extend nearly horizontally to a main production level drift 142 which is excavated in an inter-retort pillar 126 between adjacent rows of retorts. The floor of the main production level drift is generally at the same elevation as the bottom boundaries 132 of the retorts in adjacent rows or slightly below to facilitate flow of liquid. By forming the air level at the same elevation as the top of the adjacent fragmented masses, the main air level drift is as close as possible to the upper portion of the retort site and horizontal lateral passages can be used. Therefore, the air level drift can be effectively used as a retort level access drift in mining an upper void space within each retort site, in addition to later providing a means for introducing air into an upper edge of the fragmented mass during retorting operations.

It has been determined that placement of the main air level drift as shown in FIG. 3 (with the roof of the air level drift at the same elevation as the adjacent fragmented masses) can create an unstable condition in unfragmented formation adjacent the roof of the air level drift. Similarly, having the main production level drift at the same elevation as the lower boundaries of the retorts can create an even worse unstable condition in the roof of the production level drift. Such an unstable condition increases the likelihood of dangerous rock falls in the main air level drift and the production level drift.

It is believed that such an unstable condition occurs because formation of the fragmented masses in the rows of retorts reduces the amount of load support for the overburden, which creates a stress zone over the fragmented masses. The stress zone forms because the load normally supported by unfragmented formation, where the fragmented masses are now located, is transferred to the main inter-retort pillars of unfragmented formation on both sides of each row of fragmented masses. This load transfer creates a "stress arch", or "pressure arch", in the stress zone over the fragmented masses. A stress arch is the neutral axis of the stress zone above the fragmented masses, and the neutral axis of the stress zone follows a path that generally arches over the fragmented masses, with formation below the neutral axis being in tension and formation above it being in compression. When the air level drift is formed so that its roof is at about the same elevation as the top boundaries of the adjacent fragmented masses, the roof of the air level drift is in the region of the stress zone which is in tension, which increases the likelihood of rock falls since the strength of rock in tension is negligible. The floor of the drift is in more tension because the floor is more in the region between retorts when the compressive lateral stress is eliminated.

Calculations have been made of the stresses in formation adjacent the roof of the main air level 134 for the nonsubsiding embodiment of FIG. 3. According to such calculations, using the assumption that the retorts are generally square, about 150 feet wide on each side, with the inter-retort pillar 126 being about 150 feet wide, it was discovered that tension exists in the formation at the roof of the air level drift. Since rock in tension has negligible strength, the tension present in formation at the roof of the air level drift 134 raises the serious possibility of dangerous rock falls. The floor was in greater tension than the roof.

Calculations also have been made of the stresses in formation adjacent the roof of the air level drift for the embodiment of FIGS. 1 and 2, in which the roof of the main air level drift is spaced above the upper boundary of the retorts in adjacent rows. Using the same dimension assumptions as the embodiment of FIG. 3, these calculations showed that formation adjacent the roof of the air level drift is in compression. The floor is still close to being in tension. It is believed that by moving the air level drift out of the inter-retort pillar to a position in which the roof of the drift is spaced above the upper boundary of the fragmented masses, the roof of the drift is in a region of the stress field which is in compression. Having the roof of the drift in compression helps assure that dangerous rock falls are not likely. Preferably, the floor of the air level drift is also above the elevation of the upper boundaries of adjacent rows of retorts. This helps assure that the floor is not in tension. This can be less important than assuring that the roof is not in tension, but is significant for avoiding stress concentrations that could lead to damage to the main inter-retort pillar.

The roof of the production level drift can be similarly stabilized. The results of the calculations described above indicate that a stress zone is present in the inter-retort pillar near the bottoms of the adjacent retorts. This condition is even worse than the upper retort level regions because lateral stresses are larger at the bottom level of the retorts. It was also determined that formation present in the vicinity of the production level drift 142 in FIG. 3 is in tension. More specifically, the roof and floor of the production level drift is in tension when the production level drift is formed in the inter-retort pillar between adjacent rows of retorts, as for example, when the production level drift is positioned with the floor of the drift generally at about the same elevation as the lower boundaries of the retorts in the adjacent rows. The results of the calculations further indicate that the production level drift should be spaced farther below the lower boundaries of the adjacent retorts than the spacing of the air level drift above the upper boundaries of the adjacent retorts. This increased spacing eliminates the tension in the roof of the production level drift. That is, at a certain spacing distance above the retorts, tension in the roof of the air level drift goes to zero, but tension may still exist in the floor of the air level drift without as much hazard from rock falls. For the same spacing distance below the retorts, some tension still exists in the roof of the production level drift while tension in the floor goes to zero. In addition, the stress state at the bottom is worse because of larger lateral stresses associated with greater depth below ground. By moving the production level drift farther downwardly away from the bottoms of the retorts, the roof of the main production level drift goes into compression. This distance below the bottom of the retorts is greater than the distance above the retorts at which the roof of the air level drift goes into compression. With some differences due to greater depth and weight of overlying material, the stress distributions adjacent the upper and lower boundaries of the rows of retorts and adjacent inter-retort pillars are similar. The roof of the production level drift corresponds to the floor of the air level drift. Thus, to assure that the roof of the production level drift is in compression, the floor of the production level drift should be at a greater distance below the lower boundaries of adjacent retorts than the floor of the air level drift is above the upper boundaries of the retorts.

The stress distribution adjacent the upper and lower ends of the load-bearing pillar is generally similar. There is a vertical component of stress that is in compression due to weight of overlying material. There is also a horizontal component of stress which is concerned with respect to location of the main drifts. At elevations about the same as the upper or lower boundaries of the retort, the horizontal component of stress in the load-bearing pillar is in tension. If such a load-bearing pillar were extremely wide, a region free from tension may occur at a substantial distance from a row of retorts. However, such a wide pillar can be uneconomical because of the large amount of resource left undeveloped. It is found that at a reasonably short distance above the upper boundaries (or below the lower boundaries) of adjacent rows of retorts, the horizontal component of stress in the unfragmented formation is in compression. The main drifts are, therefore, spaced at sufficient elevations above or below the retorts that the roofs are in compression. The exact distance may be calculated using conventional techniques such as those mentioned in *SME Mining Engineering Handbook*, edited by Cummins & Given, published by the Society of Mining Engineers (1973), particularly Section 13. The distance includes many factors and is dependent on the dimensions of the load-bearing pillars and adjacent retorts, depth below the ground surface, properties of the unfragmented formation, partial vertical and lateral support by unfragmented formation, and the like.

Thus, in an nonsubsiding system of in situ oil shale retorts, the air level drift is excavated at an elevation above the load-bearing pillars of unfragmented formation between rows of retorts, so that the roof of the drift is spaced at or above the top boundaries of the adjacent retorts. Similarly, the roof of the production level drift is spaced even more so below the elevation of the bottom boundaries of the adjacent retorts. Each drift is spaced a sufficient vertical distance from the boundaries of the adjacent retorts to assure that the roof and floor of the drifts are in compression. Thus, unfragmented formation adjacent the roof of the air level drift and the production level drift is in compression, which substantially reduces the chances of dangerous rock falls.

What is claimed is:

1. A method for recovering liquid and gaseous products from a non-subsiding system of in situ oil shale retorts formed in a subterranean formation containing oil shale, such as in situ oil shale retort having upper, lower, and side boundaries of unfragmented formation and containing a fragmented permeable mass of formation particles containing oil shale, the method comprising the steps of:

forming spaced-apart rows of such in situ oil shale retorts in the subterranean formation containing oil shale, leaving a load-bearing inter-retort pillar of unfragmented formation between adjacent rows of such retorts, the inter-retort pillar being at least about the same order of thickness as the fragmented masses in adjacent rows of retorts on opposite sides of the inter-retort pillar such that the inter-retort pillar is sufficiently strong for supporting the weight of overburden at elevations above the adjacent rows of retorts without substantial subsidence of the overburden, the weight of the overburden being transferred to the load-bearing inter-retort pillar and thereby creating a stress zone in formation above the inter-retort pillar and the fragmented masses in the rows of retorts adjacent the pillar, a region of formation in the stress zone above the load-bearing inter-retort pillar being in compression;

excavating an air level drift in formation directly above the load-bearing inter-retort pillar of unfragmented formation, the roof of the air level drift being at an elevation spaced above the upper boundaries of retorts in such adjacent rows on opposite sides of the inter-retort pillar for placing the roof of the drift in the compression region of the stress zone for preventing tension in formation adjacent the roof;

providing fluid communication between the air level drift and an upper edge of such a retort in such a row;

establishing a combustion zone adjacent the upper edge of such a retort in such a row;

introducing an oxygen-supplying gas from the air level drift to the upper edge of such retort for advancing the combustion zone through the fragmented mass in the retort and establishing a retorting zone on the advancing side of the combustion zone for producing liquid and gaseous products of retorting; and withdrawing the liquid and gaseous products from a lower portion of the fragmented mass.

2. The method according to claim 1 including introducing such oxygen-supplying gas into the fragmented mass through at least one downwardly-inclined air inlet passage extending from the air level drift to the upper edge of the fragmented mass.

3. The method according to claim 1 including withdrawing the liquid and gaseous products from the lower edge of the fragmented mass to a production level drift below a load-bearing inter-retort pillar of unfragmented formation on the side of the retort opposite the edge where the oxygen-supplying gas is introduced, the roof of the production level drift being at an elevation below the lower boundaries of retorts in an adjacent row of retorts.

4. The method according to claim 3 including introducing such oxygen-supplying gas into the fragmented mass through at least one downwardly-inclined air inlet passage extending from the air level drift to the upper edge of the fragmented mass, and withdrawing such liquid and gaseous products through at least one downwardly-inclined product withdrawal passage which extends from the fragmented mass to the production level drift.

5. The method according to claim 3 wherein the floor of the production level drift is a greater vertical distance below the lower boundaries of the retorts in an adjacent row than the roof of the air level drift is above the upper boundaries of the retorts in the adjacent row.

6. The method according to claim 1 including forming the air level drift so that the floor of the drift is at or above the elevation of the upper boundaries of retorts in such adjacent rows.

7. A method for forming a non-subsiding system of in situ oil shale retorts in a subterranean formation containing oil shale, such as in situ oil shale retort having upper, lower, and side boundaries of unfragmented formation and containing a fragmented permeable mass of formation particles containing oil shale, the method comprising the steps of:

forming spaced apart rows of in situ oil shale retorts in the subterranean formation containing oil shale, leaving a first load-bearing inter-retort pillar of unfragmented formation between first and second rows of such retorts and leaving a second load-bearing inter-retort pillar of unfragmented formation between second and third rows of such retorts, the load-bearing pillars each being at least about the same order of thickness as the fragmented masses in adjacent rows of retorts on opposite sides of the inter-retort pillar such that the inter-retort pillar is sufficiently strong for preventing substantial subsidence of overburden above the inter-retort pillar, the weight of overburden above such first pillar being transferred to the first load-bearing inter-retort pillar and thereby creating a first stress zone in formation above the first pillar and the fragmented masses in the rows of retorts adjacent the first pillar, a region of formation in such first stress zone above such first pillar being in compression; the overburden weight also being transferred to the second load-bearing inter-retort pillar and thereby creating a second stress zone in formation below the second inter-retort pillar and below the lower boundaries of the fragmented masses in the rows of retorts adjacent the second pillar, a region of such second stress zone below the second pillar being in compression;

excavating an air level drift in such formation directly above the first load-bearing pillar of unfragmented formation, the roof of the air level drift being spaced a sufficient distance above the upper boundaries of the retorts in such adjacent first and second rows of retorts for placing the air level drift in the compression region of such first stress zone for substantially preventing tension being present in formation adjacent the floor of the air level drift;

providing fluid communication between the air level drift and retorts in the first and second rows;

excavating a production level drift in such formation directly below the second load-bearing pillar of unfragmented formation, the roof of the production level drift being spaced a sufficient distance below the lower boundaries of retorts in such adjacent second and third rows of retorts for placing the production level drift in the compression region of such second stress zone for substantially preventing tension being present in formation adjacent the roof of the production level drift; and providing fluid communication between the production level drift and retorts in such adjacent second and third rows.

8. The method according to claim 7 in which the floor of the production level drift is spaced farther below the lower boundaries of retorts in the second and third rows than the roof of the air level drift is spaced above the upper boundaries of retorts in the first and second rows.

9. A method for forming a production level drift system for a non-subsiding system of in situ oil shale retorts, such an in situ oil shale retort having upper, lower, and side boundaries of unfragmented formation and containing a fragmented permeable mass of formation particles containing oil shale, the method comprising the steps of:

forming spaced-apart rows of such in situ oil shale retorts in the subterranean formation containing oil shale, leaving a load-bearing inter-retort pillar of unfragmented formation between adjacent rows of such retorts, the pillar being at least about the same order of thickness as the fragmented masses in adjacent rows of retorts on opposite sides of the inter-retort pillar such that the inter-retort pillar is sufficiently strong for supporting the weight of overburden at elevations above the adjacent rows of retorts without substantial subsidence of the overburden; the weight of the overburden being transferred to the load-bearing inter-retort pillar and thereby creating a stress zone in formation below the inter-retort pillar between the adjacent rows of retorts, the stress zone having a region of compression spaced below the lower boundaries of the retorts;

excavating a production level drift in such formation directly below the load-bearing inter-retort pillar of unfragmented formation, the roof of the production level drift being at an elevation sufficiently far below the lower boundaries of the retorts in such adjacent rows for placing the roof in the compression region of the stress zone to substantially prevent tension being present in formation adjacent the roof of the production level drift;

providing fluid communication between a lower edge of such a retort in such a row and the production level drift;

establishing a retorting zone in the fragmented mass of such retort for producing liquid and gaseous products of retorting; and withdrawing the liquid and gaseous products from the lower edge of such retort to the production level drift.

10. The method according to claim 9 including excavating production level cross drifts between the retorts in such adjacent rows and the production level drift, the production level cross drifts being excavated downwardly at an angle toward the production level drift from the lower edge of the retorts adjacent the production level drift.

11. A non-subsiding system of in situ oil shale retorts formed within a subterranean formation containing oil shale, such an in situ oil shale retort having upper, lower, and side boundaries of unfragmented formation and containing a fragmented permeable mass of formation particles containing oil shale, the retort system comprising:

a plurality of mutually spaced-apart rows of in situ oil shale retorts;

a load-bearing inter-retort pillar of unfragmented formation separating a first row of such in situ retorts from a second row of such in situ retorts, such load-bearing pillar being sufficiently strong and of sufficient thickness that it provides a sufficiently greater amount of support for overburden than the fragmented masses in adjacent rows of in situ oil shale retorts on opposite sides of the inter-retort pillar for preventing substantial subsidence of overburden at elevations above the upper boundaries of such adjacent in situ oil shale retorts; the weight of overburden above the load-bearing inter-retort pillar being transferred to the inter-retort pillar and thereby creating a stress zone in formation above the inter-retort pillar and the fragmented masses in the first and second rows of the retorts adjacent the inter-retort pillar, a region of formation in the stress zone above the inter-retort pillar being in compression;

an air level drift formed in formation directly above the load-bearing inter-retort pillar and between the first and second rows of retorts, the air level drift having a roof located at an elevation in such formation spaced sufficiently above the upper boundaries of the retorts in the first and second rows of retorts that the roof is placed in the compression region of the stress zone so that unfragmented formation adjacent the roof is in compression; and means for providing fluid communication between the air level drift and upper edges of retorts in such adjacent rows of retorts.

12. The retort system according to claim 11 in which the means for providing fluid communication comprises separate passages extending downwardly on an angle from the air level drift into upper edges of the fragmented masses in the adjacent rows of retorts.

13. The retort system according to claim 11 in which the floor of the air level drift is above the elevation of the upper boundaries of the adjacent retorts.

14. A non-subsiding system of in situ oil shale retorts formed in a subterranean formation containing oil shale, such an in situ oil shale retort having upper, lower, and side boundaries of unfragmented formation and containing a fragmented permeable mass of formation particles containing oil shale, the retort system comprising:

a lurality of mutually spaced-apart rows of in situ oil shale retorts;

a first load-bearing inter-retort pillar of unfragmented formation separating an adjacent first row of such in situ oil shale retorts from an adjacent second row of such in situ oil shale retorts;

a second load-bearing pillar of unfragmented formation separating the second row of such in situ oil shale retorts from an adjacent third row of such in situ oil shale retorts, such first and second load-bearing pillars each being at least about the same order of thickness as the fragmented masses in the adjacent rows of retorts on opposite sides of such pillars such that the pillars are sufficiently strong for preventing substantial subsidence of overburden at elevations above the upper boundaries of such adjacent in situ oil shale retorts on opposite sides of each pillar; the weight of overburden above the first and second pillars being transferred to each pillar and thereby creating first and second stress zones in formation above the first pillar between the first and second rows of retorts and below the second pillar between the second and third rows of retorts, respectively; the first and second stress zones having regions of compression above and below the upper and lower boundaries of their adjacent rows of retorts, respectively;

an air level drift formed in formation directly above the first load-bearing inter-retort pillar and between the first and second rows of retorts, the air level drift having a roof located at an elevation in such formation sufficiently spaced above the upper boundaries of the retorts in the first and second rows of retorts for placing the roof in the compression region of the first stress zone so that unfragmented formation adjacent the roof is in compression;

means for providing fluid communication between the air level drift and the fragmented masses of the first and second rows of retorts;

a poduction level drift formed in formation directly below the second load-bearing pillar and between the second and third rows of retorts, the production level drift having a roof located at an elevation in such formation spaced sufficiently below the lower boundaries of the retorts in the second and third rows of retorts to place the roof in the compression region of the second stress zone so that unfragmented formation adjacent the roof of the production level drift is in compression; and means for providing fluid communication between the fragmented masses of the second and third retorts and the production level drift.

15. The retort system according to claim 14 in which the roof of the production level drift is spaced farther below the lower boundaries of the second and third rows of retorts than the floor of the air level drift is spaced above the upper boundaries of the first and second rows of retorts.

16. The retort system according to claim 14 including downwardly inclined passages for providing fluid communication between the air level drift and nearest upper edges of the retorts in the first and second rows of retorts, and downwardly-inclined production level passages providing fluid communication between nearest lower edges of the retorts of the second and third rows of retorts and the production level drift on the opposite side of the retorts from such upper edges.

17. In a method of forming a non-subsiding system of in situ oil shale retorts in a subterranean formation containing oil shale; wherein such an in situ oil shale retort has upper, lower, and side boundaries of unfragmented formation and contains a fragmented permeable mass of formation particles containing oil shale; wherein adjacent retorts in such a system are separated by an inter-retort pillar of unfragmented formation; and wherein oxygen-supplying gas is introduced into an upper edge of such a fragmented mass during retorting operations from an air level drift adjacent a side boundary of the fragmented mass, the improvement wherein the inter-retort pillar is a load-bearing pillar of sufficient thickness that such an air level drift can be excavated along the pillar between adjacent rows of fragmented masses and still have sufficient structural integrity to support overburden loads without failure and without causing substantial subsidance of overburden above the pillar; wherein overburden loads are transferred to such a load-bearing pillar and thereby create a stress zone in formation above the pillar and the fragmented masses in adjacent retorts on opposite sides of the pillar, a region of formation in the stress zone above the inter-retort pillar being in compression; and wherein the air level drift is positioned directly above the load-bearing pillar so the roof of the air level drift is spaced sufficiently far above the upper boundaries of the fragmented masses in adjacent retorts to place formation adjacent the roof of the air level drift in the compression region of the stress zone.

18. The improvement according to claim 17 including positioning the floor of the air level drift at or above the elevation of the upper boundaries of the fragmented masses in adjacent retorts.

19. A non-subsiding system of in situ oil shale retorts in a subterranean formation containing oil shale; wherein such an in situ oil shale retort has upper, lower, and side boundaries of unfragmented formation and contains a fragmented permeable mass of formation particles containing oil shale; wherein adjacent mutually spaced apart rows of such retorts are separated by load-bearing inter-retort pillars of unfragmented formation sufficiently strong and of sufficient thickness that they provide a sufficiently greater amount of support for overburden than the fragmented masses in the rows of retorts on opposite sides of such load-bearing inter-retort pillar for supporting the weight of overburden without substantial subsidence of overburden above such inter-retort pillar, the weight of overburden above a first inter-retort pillar being transferred to the pillar and thereby creating a first stress zone in formation above the fragmented masses adjacent opposite sides of the first pillar and above the first inter-retort pillar, a region of formation in the first stress zone above the first inter-retort pillar being in compression; and in which overburden loads are transferred to a second inter-retort pillar on a side of the retorts opposite the first inter-retort pillar and thereby create a second stress zone in formation below the fragmented masses adjacent opposite sides of the second inter-retort pillar and below the second inter-retort pillar, a region of formation in the second stress zone below the second inter-retort pillar being in compression; wherein oxygen-supplying gas in introduced into an upper edge of such a fragmented mass during retorting operations from an air level drift spaced laterally from a first side boundary of the fragmented mass; wherein off gas and liquid products of retorting are withdrawn from a lower edge of such a fragmented mass opposite the air level drift through a production level drift spaced laterally from a second side boundary of the fragmented mass, such that gas flow during retorting operations is diagonally through the fragmented mass from the upper edge toward the opposite lower edge of the fragmented mass; and in which the floor of the air level drift is spaced sufficiently far above the upper boundary of the fragmented mass to place formation adjacent the roof of the air level drift in the compression region of the first stress zone, and the floor of the production level drift is spaced sufficiently far below the lower boundary of the fragmented mass to place formation adjacent the roof of the production level drift in the compression region of the second zone.

* * * * *